United States Patent [19]

Miyakawa et al.

[11] 4,404,269

[45] Sep. 13, 1983

[54] DEVELOPER CONTAINING MAGNETIC AND NON-MAGNETIC TONER

[75] Inventors: Nobuhiro Miyakawa, Suita; Kouzi Maekawa, Kyoto; Masanori Fujii, Suita, all of Japan

[73] Assignee: Mita Industrial Co., Ltd., Osaka, Japan

[21] Appl. No.: 320,938

[22] Filed: Nov. 13, 1981

[30] Foreign Application Priority Data

Nov. 17, 1980 [JP] Japan ..... 55-160885

[51] Int. Cl.[3] ..... G03G 9/14

[52] U.S. Cl. ..... 430/106; 430/106.6; 430/109; 430/110; 430/111

[58] Field of Search ..... 430/106.6, 109, 110, 430/106

[56] References Cited

U.S. PATENT DOCUMENTS

| | | | |
|---|---|---|---|
| 2,965,573 | 12/1960 | Gundlach . | |
| 3,234,017 | 2/1966 | Heyl . | |
| 3,520,811 | 7/1970 | Swoboda . | |
| 4,031,021 | 6/1977 | Deming | 430/106.6 |
| 4,142,981 | 3/1979 | Bean et al. | 430/109 |
| 4,165,393 | 8/1979 | Suzuki et al. . | |
| 4,218,530 | 8/1980 | Lu . | |
| 4,239,845 | 12/1980 | Tanaka et al. | 430/109 X |
| 4,272,600 | 6/1981 | Sypula et al. . | |
| 4,277,552 | 7/1981 | Asanae et al. . | |
| 4,311,779 | 1/1982 | Miyakawa et al. . | |
| 4,315,064 | 2/1982 | Miyakawa et al. . | |
| 4,331,757 | 5/1982 | Tanaka et al. | 430/109 X |
| 4,345,014 | 8/1982 | Oka et al. | 430/106.6 X |
| 4,362,802 | 12/1982 | Tanaka et al. | 430/106.6 |

FOREIGN PATENT DOCUMENTS

| | | | |
|---|---|---|---|
| 2847768 | 10/1979 | Fed. Rep. of Germany | 430/106.6 |
| 2074745 | of 1981 | United Kingdom . | |

*Primary Examiner*—Roland E. Martin, Jr.
*Attorney, Agent, or Firm*—Sherman & Shalloway

[57] ABSTRACT

A two-component dry-type composite developer which is a mixture of 100 parts of (A) magnetic toner particles of a binder resin and 40 to 70% by weight of magnetite having a bulk density of at least 0.45 g/ml, a number average maximum size of at least 0.5 μm and a maximum size/minimum size ratio of from 1.0 to 5.5 and 1 to 30 parts of (B) non-magnetic toner particles of binder resin, pigment and negative charge controlling agent. The magnetic toner particles have an electrostatic capacitance of 7 to 8.5 picofarad, a dielectric constant of 3.59 to 4.36, and a volume resistivity of 1.2 to $8.6\times10^{14}$ Ω-cm, and the nonmagnetic toner particles have an electrostatic capacitance of 6.0 to 8.0 picofarad and a dielectric constant of 3.08 to 4.10. The toner particles (A) and (B) have friction chargeability characteristics of the same polarity and are consumed at the same rate during development such that the mixing ratio remains constant and the development characteristics are not changed during use. Copies of from soft to hard tones can be obtained by changing the mixing ratio. Development and transfer efficiencies are improved.

8 Claims, 3 Drawing Figures

DEVELOPER CONTAINING MAGNETIC AND NON-MAGNETIC TONER

BACKGROUND OF THE INVENTION (1) Field of the Invention

The present invention relates to a composite developer comprising a mixture of magnetic toner particles and non-magnetic toner particles. More particularly, the present invention relates to a composite developer comprising a mixture of magnetic toner particles and non-magnetic toner particles, in which both the particles have a friction chargeability characteristic of the same polarity and both the components therefore are consumed at the same rate at the time of development, with the result that no change is caused in the composition of the developer.

(2) Description of the Prior Art

In the electrophotographic reproduction or electrostatic recording, a magnetic brush development method is widely used as means for developing an electrostatic latent image. A two-component type developer and a one-component type developer are known as the developer that can be used in this magnetic brush development method. In each case, the developer is held on a non-magnetic sleeve provided with a magnet in the interior thereof to form a magnetic brush and a visible image is formed by sliding contact of this magnetic brush with an electrostatic latent image supporting-substrate.

The developer to be used in this developing method should have both the magnetic attractability and electrostatic attractability. In case of the two-component type developer, a mixture of a carrier comprising a magnetic powder such as iron powder and colored electroscopic fixable particles is used and by friction between the two components, the fixable particles are electrically charged and electrostatic attractability is given thereto. Accordingly, in the known two-component type developer, only the electroscopic fixable particles, that is, toner particles, are consumed, and the composition of the developer is gradually changed. Therefore, it is necessary to conduct troublesome operations of adjusting the composition of the developer at times and exchanging the degraded carrier formed by long-time use with a fresh carrier.

There has recently been proposed a composite developer formed by mixing magnetic toner particles composed of a dispersion of a powdery magnetic material in a binder resin medium with non-magnetic toner particles composed of a dispersion of a coloring material in an electrically insulating binder resin medium. Also in the developer of this type, non-magnetic toner particles are electrically charged by frictional contact with magnetic toner particles, and the non-magnetic toner particles are consumed in larger quantities for the development. Accordingly, also the composite developer of this type is inevitably defective in that the composition of the developer is readily changed while it is used.

SUMMARY OF THE INVENTION

We found that in a composite developer comprising magnetic toner particles and non-magnetic toner particles, if specific magnetite is selected as the magnetic material in the magnetic toner particles and if magnetic toner particles and non-magnetic toner particles having specific electrostatic capacitances and dielectric constants are combined at a specific ratio, visualization of an electrostatic latent image is possible even though both the toner particles have a friction chargeability characteristic of the same polarity and during the development operation, both the magnetic toner particles and the non-magnetic toner particles are simultaneously consumd while the initial developer composition is kept, with the result that the problems of change of the composition of the developer during use and degradation of the developer components can effectively be solved.

Furthermore, it was found that when the mixing ratio of the magnetic toner particles to the non-magnetic toner particles in the above-mentioned composite developer is changed within a certain range, an image having a desirable latitude, for example, a hard-tone image or a soft-tone image, can optionally be obtained and that this composite developer is especially excellent in the reproduction of a half tone and also excellent in the image sharpness and resolving power.

In accordance with the present invention, there is provided a two-component simultaneously consumable, dry-type composite developer which comprises a mixture of magnetic toner particles composed of a dispersion of a powdery magnetic material in an electrically insulating binder resin medium and non-magnetic toner particles composed of a dispersion of a coloring agent in an electrically insulating binder resin medium, wherein the magnetic toner particles contain magnetite having a bulk density of at least 0.45 g/ml, a number average maximum size as measured by an electron microscope of at least 0.5 μm and a maximum size/minimum size ratio of from 1.0 to 5.5, the magnetic toner particles have an electrostatic capacitance of 7 to 8.5 pF (picofarad) and a dielectric constant of 3.59 to 4.36, as determined under conditions of an electrode gap of 0.65 mm, an electrode sectional area of 1.43 $cm^2$ and an inter-electrode load of 105 $g/cm^2$, the non-magnetic toner particles have an electrostatic capacitance of 6.0 to 8.0 pF and a dielectric constant of 3.08 to 4.10, as determined under said conditions, the magnetic toner particles and the non-magnetic toner particles have a friction chargeability characteristic of the same polarity, and the magnetic toner particles and the non-magnetic toner particles are present in the developer at a weight ratio of from 100:1 to 100:30.

DETAILED DESCRIPTION OF THE PREFERRED EMBODIMENTS

Figure 1:
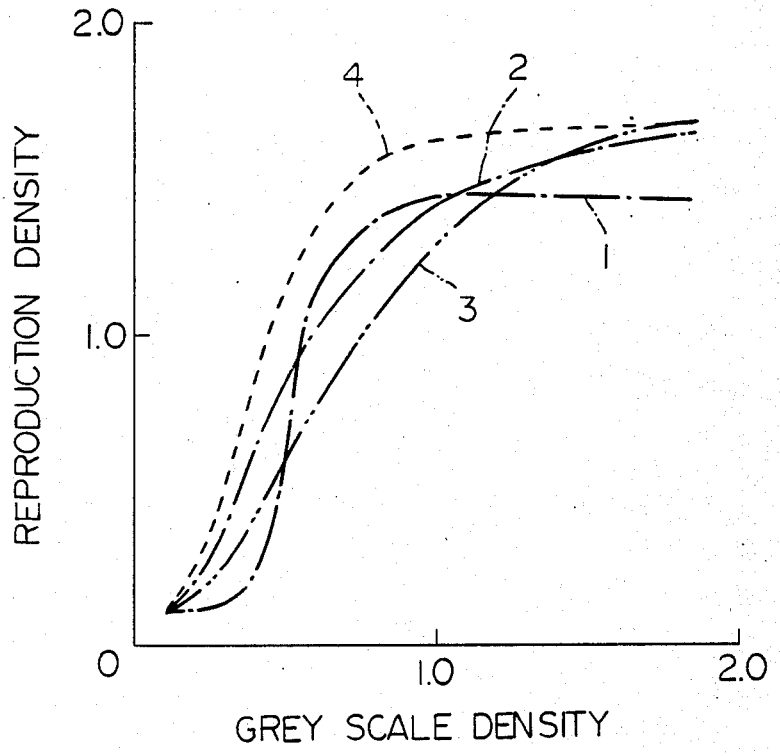
FIG. 1 is a graph illustrating the relation between the grey scale density and the reproduction density in a print obtained by using the composite developer of the present invention.

One of important features of the present invention is that the composite developer is formed by combining magnetic toner particles having an electrostatic capacitance of 7 to 8.5 pF (picofarad), especially 7.2 to 8.2 pF, and a dielectric constant of 3.59 to 4.36, especially 3.69 to 4.21, as determined under conditions of an electrode gap of 0.65 mm, an electrode sectional area of 1.43 $cm^2$ and an inter-electrode load of 105 $g/cm^2$ with non-magnetic particles having an electrostatic capacitance of 6.0 to 8.0 pF, especially 6.2 to 7.7 pF, and a dielectric constant of 3.08 to 4.10, especially 3.18 to 3.95, as determined under the above-mentioned conditions.

Magnetic toner particles heretofore used are electrically insulating. For example, as disclosed in Japanese Patent Application Laid-Open Specification No. 95954/80 previously filed by us, when a customary binder resin medium, such as an epoxy resin, a polyamide resin or a polyester, is employed, the resulting magnetic toner particles have an electrostatic capacitance larger than 9 pF and a dielectric constant larger than 4.62. Furthermore, so-called conductive toner particles have larger electrostatic capacitance and dielectric constant.

When such conventional magnetic toner particles are mixed with non-magnetic toner particles for developing a positively charged image and the resulting composite developer is used for magnetic brush development of a positively charged image, the magnetic toner particles are charged with a polarity reverse to the polarity of the non-magnetic toner particles, and the non-magnetic toner particles are consumed in larger quantities than the magnetic toner particles and the composition of the developer is changed while it is used.

In contrast, if magnetic toner particles and non-magnetic toner particles having electrostatic capacitances and dielectric constants within the above-mentioned ranges are selected according to the present invention and they are combined with each other, both the toner particles come to have a friction chargeability characteristic of the same polarity, for example, the negative polarity and by virtue of the cohesive force acting between the two toner particles, both the toner particles act as if they are one-component type magnetic toner particles, with the result that the developer is consumed while the original composition is retained. The criticalities of the electrostatic capacitances and dielectric constants of the magnetic toner particles and non-magnetic toner particles will become apparent from Examples described hereinafter.

In the present invention, in order to obtain magnetic toner particles having the above-mentioned electric properties, it is important that as the powdery magnetic material to be contained in the magnetic toner particles, there should be selected and used finely divided magnetite having a bulk density of at least 0.45 g/ml (in the instant specification, by the term "bulk density" is meant a value as determined according to the method of JIS K-5101), a number average maximum size as measured by an electron microscope (often referred to as "particle size") of at least 0.5 μm and a shape anisotropy of 1.0 to 5.5.

The triiron tetroxide (magnetite) used in the present invention is characteristic over triiron tetroxide heretofore used in this field in that the bulk density is high, the particle size is relatively large and the shape anisotropy is small. Ordinarily, triiron tetroxide customarily used for magnetic developers has a number average particle size of 0.1 to 0.3 μm and a bulk density of about 0.3 to about 0.4 g/ml, and in so-called needle triiron tetroxide, the shape anistropy, that is, the maximum size/minimum size ratio, is larger than 6. If a powdery magnetic material having a bulk density of at least 0.45 g/ml, a particle size of at least 0.5 μm and a shape anisotropy of 1.0 to 5.5 is selected and used according to the present invention, a prominent advantage of simultaneous consumption of the components of the composite developer can be attained. Furthermore, the development efficiency and transfer efficiency are increased. The reasons have not been completely elucidated but the following can be considered. The development efficiency of a magnetic developer is influenced by the balance between a magnetic attracting force and a Coulomb force, which simultaneously act on the developer particles. When the powdery magnetic material defined in the present invention is used, since the dielectric constant of the developer is controlled to a relatively low level within a certain range, charging of respective developer particles becomes easy, and since also the electrostatic capacitance of the developer is controlled to a low level, escape of the charge applied to the developer particles is reduced, with the result that, it is believed, both the development efficiency and the transfer efficiency are increased.

A magnetic material having the above-mentioned bulk density and particle size characteristics is easily available as a relatively coarse product selected among cubic triiron tetroxides and slightly rounded amorphous triiron tetroxides. Triiron tetroxides of this type ordinarily have a shape anisotropy included in a preferred range of from 1.0 to 3.0. Furthermore, triiron tetroxide closer to a needle crystal may be used if the shape is relatively stocky and the shape anisotropy is smaller than 5.5.

The triiron tetroxide having the above-mentioned characteristics can be prepared by the following process, though the preparation process is not limited to one described below. An aqueous solution of sodium hydroxide is added to an aqueous solution of iron (III) sulfate to form a precipitate of iron (III) hydroxide. The precipitate is subjected to a hydrothermic treatment under pressure while maintaining the pH value of the mother liquor at 4 to 10 to convert the gelatinous precipitate of iron (III) hydroxide to cubic $Fe_2O_3$ (Hematite). The conditions for the production of this cubic α-diiron trioxide are described in detail in, for example, Nobuoka et al., Kogyo Kagaku Zasshi, 66, page 412 (1963). The hydrothermic treatment may be carried out at a temperature of 150° to 230° C. for 10 to 100 hours. Ordinarily, the higher is the pH value of the mother liquor, the larger is the particle size of the resulting diiron trioxide. α-Diiron trioxide having a predetermined particle size can be obtained by adjusting this pH condition and the treatment temperature and time. When the so-obtained α-diiron trioxide is subjected to a reducing treatment under known conditions, cubic triiron tetroxide ($Fe_3O_4$) is obtained. The reducing treatment is carried out, for example, at 400° C. in a reducing furnace in a hydrogen current, so that the $Fe^{2+}/Fe^{3+}$ atomic ratio in the resulting triiron tetroxide is ordinarily in the range of from 0.9/1.0 to 1.1/1.0, whereby cubic triiron tetroxide having the above-mentioned characteristics can be obtained.

When the above-mentioned α-diiron trioxide precursor is prepared, if the hydrothermic treatment is carried out at a relatively low pH value, cubes are rounded and amorphous triiron tetroxide having a relatively round shape is sometimes obtained.

It is preferred that the coercive force (Hc) of triiron tetroxide used in the present invention be less than 200 Oe, especially less than 150 Oe.

In a most preferred embodiment of the present invention, magnetite particles consisting of non-pulverizable agglomerates of cubic particles and having a number average particle size of 1 to 10 μm as measured by an electron microscope are used as the above-mentioned magnetite particles.

By the "non-pulverizable agglomerates" in the instant specification are meant agglomerates consisting of fine particles which aggregate closely and densely so that the particle size is not substantially changed by an ordinary pulverizing treatment, for example, 5 hours' ball milling.

The number average particle size of such non-pulverizable agglomerate is 1 to 10 μm, especially 2 to 7 μm, as measured by an electron microscope, and the non-pulverizable agglomerates have a particle size larger than that of ordinary magnetite particles.

The magnetite particles consisting of such non-pulverizable agglomerates have the above-mentioned close and dense aggregate structure and the particle size is relatively large. Accordingly, they are characteristic over needle crystals customarily used for magnetic developers and the above-mentioned cubic or amorphous magnetite particles in that the volume per unit weight, that is, the bulk, is small. Accordingly, it will readily be understood that if the comparison is made based on the same mixing weight ratio of magnetite, the resin/magnetite volume ratio can be made much larger than in conventional one-component type developers and therefore, inherent charge characteristics of the resin can be given more greatly to the magnetic toner particles.

It is known that a polymeric material having a larger dielectric constant is more easily positively charged by friction (see the Society of Photographic Scientists and Engineers, 2nd Int. Conf., 1974, pages 95 through 100). Furthermore, in case of a magnetic developer comprising a dispersion of a powdery magnetic material in a binder medium, we have already found that if the dielectric constant of this magnetic developer is small, it tends to be negatively charged by friction and if the dielectric constant of the magnetic developer is large, it tends to be positively charged by friction. When ordinary magnetite is incorporated in an amount of 55% by weight in a styrene type resin, the resulting developer particles have a dielectric constant of 3.85 to 4.05, while developer particles formed by incorporating the above-mentioned non-pulverizable agglomerates in the same amount have a dielectric constant of 3.79. Accordingly, the latter developer particles are more easily negatively charged by friction.

As is apparent from the foregoing description, the powdery magnetic material used in the present invention has a smaller bulk, that is, a larger apparent density, than ordinary magnetite. More specifically, the powdery magnetic material has an apparent density of 0.5 to 1.5 g/ml, especially 0.7 to 1.3 g/ml, as measured according to the method of JIS K-5101.

The non-pulverizable agglomerates consisting of cubic particles are characterized by a saturation magnetization of 75 to 88 emu/g, a residual magnetization of 3 to 12 emu/g and a coercive force of 40 to 150 Oe.

The non-pulverizable agglomerates are prepared according to the above-mentioned process for the preparation of magnetite, in which a weakly alkaline aqueous solution such as aqueous ammonia is used for neutralization of iron (III) sulfate and the pH value of the mother liquor is adjusted to a level closer to the acid side to form fine cubic particles which are likely to aggregate and the hydrothermic treatment is carried out at a temperature of 150° to 230° C. for a time longer than 50 hours to effect aging.

As the binder resin medium for dispersing magnetite in the magnetic toner particles, there are used resins which are electrically insulating and show a binding property under application of heat or pressure, singly or in combination with waxes or rubbers. A plurality of these binder resin media may be used in combination. It is preferred that the binder resin medium to be used in the present invention should have a volume resistivity of at least $1\times10^{15}\Omega$-cm as measured in the state where magnetite is not incorporated.

As the binder medium, there may be used homopolymers and copolymers of various mono- and di-ethylenically unsaturated monomers, especially (a) vinyl aromatic monomers and (b) acrylic monomers.

As the vinyl aromatic monomer, there are preferably used monomers represented by the following formula:

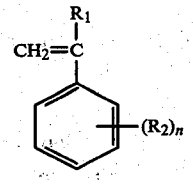

wherein $R_1$ stands for a hydrogen atom, a lower alkyl group (having up to 4 carbon atoms) or a halogen atom, $R_2$ stands for a substituent such as a lower alkyl group or a halogen atom, and n is an integer of from 0 to 2, for example, styrene, vinyltoluene, α-methylstyrene, α-chlorostyrene, vinyl xylene and vinyl naphthalene. Among these vinyl aromatic monomers, styrene and vinyl toluene are especially preferred.

As the acrylic monomer, there can be mentioned monomers represented by the following formula:

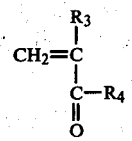

wherein $R_3$ stands for a hydrogen atom or a lower alkyl group, and $R_4$ stands for a hydroxyl group, an alkoxy group, a hydroxyalkoxy group, an amino group or an aminoalkoxy group, for example, acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropyl acrylate, 3-N,N-diethylaminopropyl acrylate and acrylamide.

As the monomer that is used in combination with the above-mentioned monomer (a) or (b) or singly, there can be mentioned conjugated diolefin monomers represented by the following formula:

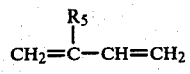

wherein $R_5$ stands for a hydrogen atom, a lower alkyl group or a chlorine atom, for example, butadiene, isoprene and chloroprene. Furthermore, there can be mentioned ethylenically unsaturated carboxylic acids such as maleic anhydride, fumaric acid, crotonic acid and itaconic acid, esters thereof, vinyl esters such as vinyl acetate, and vinyl pyridine, vinyl pyrrolidone, vinyl ether, acrylonitrile, vinyl chloride and vinylidene chloride.

It is preferred that the molecular weight of such vinyl polymer be 3000 to 300000, especially 5000 to 200000. A homopolymer or copolymer of a vinyl aromatic hydrocarbon or a polymer blend containing such homopolymer or copolymer is most preferred as the binder resin. In case of the copolymer or polymer blend, it is preferred that the content of the vinyl aromatic hydrocarbon units be at least 25% by weight.

In the present invention, it is preferred that the above-mentioned magnetite be used in an amount of 40 to 70% by weight, especially 45 to 65% by weight, based on the sum of the binder medium and powdery magnetic material. The magnetite is homogeneously and uniformly kneaded with the binder medium, and the kneaded mixture is granulated to obtain magnetic toner particles.

Prior to kneading and granulation of the developer components, known auxiliary components may be added according to the known recipe. For example, in order to improve the hue of the magnetic toner particles, there may be used a pigment such as carbon black and a dye such as Acid Violet singly or in combination in an amount of 0.5 to 5% by weight based on the total amount. Moreover, for the bulking purpose, there may be added a filler such as calcium carbonate or finely divided silica in an amount of up to 20% by weight based on the total amount. When a method of fixing the developer by a hot roll is adopted, an offset-preventing agent such as a low-molecular-weight olefin resin or a wax may be added in an amount of 2 to 15% by weight based on the total amount. When a method of fixing the developer by a pressure roll is adopted, a pressure fixability improver such as paraffin wax, an animal or vegetable wax or a fatty acid amide may be added in an amount of 5 to 30% by weight based on the total amount. In order to prevent cohesion of the magnetic toner particles and improve the flowability thereof, a flowability improver such as finely divided polytetrafluoroethylene or finely divided silica may be added in an amount of 0.1 to 1.5% by weight based on the total amount.

At the molding step, the kneaded composition is cooled and pulverized, followed by classification according to need. Of course, mechanical rapid stirring may be carried out so as to remove corners of amorphous particles.

It is ordinarily preferred that the number average particle size of the magnetic toner particles be in the range of from 5 to 35 μm and at least 2 times the number average particle size of the magnetite particles, though the preferred average particle size differs to some extent according to the intended resolving power.

The non-magnetic toner particles can be obtained by dispersing a coloring agent into the above-mentioned electrically insulating binder resin medium and granulating the dispersion. As the binder resin medium, there can be used the same resins as described hereinbefore with respect to the magnetic toner particles, especially homopolymers and copolymers of vinyl aromatic hydrocarbons and polymer blends containing these polymers.

As the coloring agent, there may be used pigments such as carbon black and dyes also acting as a negative charge controlling agent. These coloring agents may be used singly or in the form of a mixture of two or more of them. The coloring agent is used in an amount of 2 to 10% by weight, especially 3 to 7% by weight, based on the non-magnetic toner particles. As the dye, there are preferably used complex salt azo dyes containing chromium, iron or cobalt, which are alcohol-soluble. An especially preferred complex salt dye is a 2:1 type metal complex salt dye represented by the following formula:

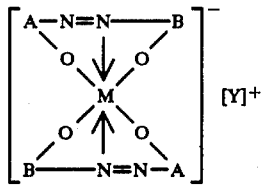

wherein

A stands for a residue of a diazo component having a phenolic hydroxyl group at the ortho-position, B stands for a residue of a coupling component, M stands for chromium, iron or cobalt, and $[Y]^+$ represents an inorganic or organic cation.

In addition, there may be used a sulfonylamine derivative of copper phthalocyanine for attaining the objects of the present invention.

As typical instances of the metal-containing complex salt dye, there can be mentioned a chromium-containing complex of C.I. Acid Black 123, C.I. Solvent Black 22, C.I. Solvent Black 23, C.I. Solvent Black 28, C.I. Solvent Black 37, C.I. Solvent Black 42, C.I. Solvent Black 43, C.I. Solvent Red 8, C.I. Solvent Red 109, C.I. Solvent Yellow 80, C.I. Solvent Orange 37, C.I. Solvent Orange 45, C.I. Solvent Violet 21 and C.I. Solvent Blue 25. These dyes also acting as the negative charge controlling agent may be incorporated not only into the non-magnetic toner particles but also into the magnetic toner particles.

The non-magnetic toner particles can be prepared according to the same method as the above-mentioned method for preparing the magnetic toner particles except that the powdery magnetic material is not added. Ordinarily, the particle size of the non-magnetic toner particles is in the range of from 5 to 35 μm, and it may be equal to or larger or smaller than the particle size of the magnetic toner particles.

According to the present invention, the magnetic toner particles are mixed with the non-magnetic toner particles at a weight ratio of from 100:1 to 100:30, especially from 100:2 to 100:20. If the magnetic toner particles are blended with the non-magnetic toner particles at this weight ratio, there can be provided a developer characterized in that when this developer is used, both the components are consumed while retaining this weight ratio. Furthermore, both the development efficiency and the transfer efficiency of the developer as a whole can be increased. If the amount of the non-magnetic toner particles is too large and exceeds the above range, fogging of the background tends to increase.

In the present invention, if the weight ratio of the magnetic toner particles to the non-magnetic toner particles is changed within the above-mentioned range, the latitude of the formed image can optionally be adjusted from a hard tone to a soft tone. If the weight ratio of the magnetic toner particles is higher in the above-mentioned range, the obtained developer is suitable for reproduction of an image of a harder tone, and if the weight ratio of the non-magnetic toner particles is larger in the above-mentioned range, the obtained developer is suitable for reproduction of an image of a softer tone.

The developer of the present invention is especially advantageous in that when the developer having a certain composition is used for reproduction of a hard or soft tone image, the original composition is always kept while it is used. In conventional composite developers, in case of reproduction of a soft tone image, non-magnetic toners are consumed in larger quantities and in case of reproduction of a hard tone image, magnetic toner particles are consumed in larger quantities, with the result that the balance of the composition of the developer is readily lost while the developer is used. According to the present invention, occurrence of this disadvantage can be prevented by virtue of the above-mentioned combination of the electric characteristics.

In the electrostatic photographic reproduction process using the developer of the present invention, formation of an electrostatic latent image is accomplished according to any of known methods. For example, there may be adopted a method in which a photoconductive layer formed on a conductive substrate is uniformly charged and is then exposed to light imagewise to form an electrostatic latent image.

The surface of the substrate having the so-formed electrostatic latent image thereon is brought into contact with a magnetic brush of the above-mentioned composite developer to form a visible image of the developer.

When an electrostatic latent image is developed with the composite developer of the present invention, the composite developer is charged in a developer hopper, on an opening formed on the lower end of which is rotatably mounted a non-magnetic sleeve. A magnet is disposed in the interior of this sleeve so that the magnet is rotated in a direction opposite to the rotation direction of the sleeve. When the sleeve and magnet are rotated, a brush layer of the magnetic developer is formed on the sleeve, and after this brush layer is cut in an appropriate length by a spike-cutting plate, a selenium drum rotating in the same direction as the rotation direction of the brush layer is brought into light contact with the brush layer in the contact zone of the brush layer, whereby an electrostatic latent image on the selenium drum is developed with the composite developer.

Then, the developer image on the substrate is brought into contact with a transfer sheet and corona discharge of the same polarity as that of the electrostatic latent image is effected from the back surface of the transfer sheet to transfer the developer image onto the transfer sheet.

In the present invention, for fixation of the transferred image, there may be appropriately chosen and adopted a hot roller fixation method, a flash lamp fixation method, a pressure roller fixation method or a combination thereof according to the kind of the developer.

The developer of the present invention is especially useful for developing a positively charged image on a p-type photosensitive plate such as a selenium photosensitive plate or an organic photoconductor photosensitive plate.

The present invention will now be described in detail with reference to the following Examples that by no means limit the scope of the invention. Incidentally, all of "parts" and "%" in these Examples are by weight unless otherwise indicated.

EXAMPLE 1

By using a two-roll mill, 55 parts of magnetite ($Fe_3O_4$) shown in Table 1 was kneaded with 37 parts of a vinyl toluene/2-ethylhexyl acrylate copolymer (molar ratio = 17:8, weight average molecular weight = 83000), 8 parts of low-molecular-weight polypropylene (average molecular weight = 4000) and 0.5 part of zinc stearate at 150° C. for 25 minutes. The kneaded mixture was naturally cooled, roughly pulverized to 0.5 to 2 mm by a cutting mill, finely pulverized by a jet mill and then subjected to zigzag classification to obtain a magnetic toner having a particle size of 5 to 85 μm. The classification was carried out so that the lower limit of this particle size was at least 2 times the particle size of the starting magnetite.

TABLE 1

| Magnetite | Apparent Density (g/ml) | Number Average Particle Size (μ) | Coercive Force (Oe) | Saturation Magnetization (emu/g) | Residual Magnetization (emu/g) |
|---|---|---|---|---|---|
| a | 0.635 | 1 | 148 | 84.2 | 10.6 |
| b | 0.972 | 3 | 54 | 87.2 | 5.1 |
| c | 1.204 | 5 | 100 | 77.4 | 8.6 |
| d | 0.880 | 7 | 90 | 78.1 | 8.0 |

Separately, 100 parts of a polystyrene resin (average molecular weight = 5000) was melt-kneaded with 5 parts of carbon black (Special Black 4 supplied by Degusa Co.) and 4 parts of a negative charge controlling agent (Spiron Black TOH supplied by Hodogaya Kagaku K.K.) by a two-roll mill in the same manner as described above, and the kneaded mixture was pulverized and classified to obtain a non-magnetic toner having a particle size of 5 to 25 μm.

The non-magnetic toner was incorporated in an amount of 10% into each of the above-mentioned 4 kinds of the magnetic toners to prepare composite developers. The copying test was carried out by using these composite developers in the following manner.

In a copying machine comprising a selenium drum (outer diameter = 150 mm) as a photosensitive material, the intensity of a magnetic field on a developing sleeve (outer diameter = 33 mm) having a magnet installed therein through a non-magnetic member was adjusted to about 900 gauss, the above-mentioned magnetic toner particles were applied to a so-called dual rotation type developing roller capable of rotating the magnet and the sleeve independently, so that the gap between spike-cutting plate and the sleeve was 0.3 mm. A developer hopper was arranged so that the magnetic toner particles could be supplied to the developing roller zone from the hopper, and the distance between the surface of the photosensitive material and the developing roller was adjusted to 0.5 mm. In the contact zone of the brush layer, the developing sleeve (brush layer) and the photosensitive material were rotated in the same direction and the magnet was rotated in a direction opposite to the rotation direction of the sleeve. Under such rotation conditions, charging (+6.7 KV), light exposure, development, transfer (+6.3 KV), heated roller fixation and fur brush cleaning were carried out. Slick paper having a thickness of 80 μm was used as a transfer sheet. The results of the copying test are shown in Table 2. The image density was determined by measuring the density of the solid black portion by a commercially available reflection densitometer (Sakura Densitometer PDA-65 supplied by Konishiroku Shashin Kogyo K.K.). A Copia test pattern supplied by Data Quest Co. and a grey scale supplied by Kodak Co. were used as a copying test chart, and the graduation, sharpness and resolving power were judged from the obtained prints.

Incidentally, composite developers a', b', c' and d' correspond to the magnetites a, b, c and d shown in Table 1, respectively.

TABLE 2

| Composite Developer | Image Density | Background Density | Sharpness | Resolving Power (lines/mm) | Graduation (steps) |
|---|---|---|---|---|---|
| a' | 1.60 | 0.09 | good | 8.0 | 10 |
| b' | 1.62 | 0.10 | good | 8.0 | 10 |
| c' | 1.60 | 0.10 | good | 8.0 | 10 |
| d' | 1.60 | 0.10 | good | 8.0 | 10 |

Incidentally, the graduation was evaluated based on the number of steps that could be confirmed by the naked eye observation of a print obtained by conducting the copying test by using the grey scale of Kodak Co.

In each of these composite developers, it was found that the image density of the print was high, no edge effect was caused and both the sharpness and resolving power were excellent, and it also was found that the denselight tone could be reproduced faithfully according to the color tone of the test pattern and all the steps (10 steps) of the grey scale of Kodak Co. could be confirmed. Thus, it was found that these developers could reproduce a half-tone image effectively.

For comparison, a so-called two-component type developer formed by mixing the non-magnetic toner particles (electrostatic capacitance=6.4 pF, dielectric constant =3.28 ) used in this Example with a carrier (TEFV 200/300 supplied by Nippon Teppun K.K.) at a weight ratio of 8/92 was used for the copying test using the grey scale as an original and a different development apparatus in which the magnet was kept stationary but the sleeve alone was rotated. The obtained results are indicated by curve 1 of FIG. 1. Incidentally, curve 2 in FIG. 1 indicates the results of the copying test using magnetic toner particles prepared by using the magnetite b shown in Table 1, and curves 3 and 4 indicate results of the copying test using the developers of the present invention prepared by mixing 10 and 20% of the above-mentioned non-magnetic toner particles with the above-mentioned magnetic toner particles (magnetite b shown in Table 1 was contained). From the results shown in FIG. 1, it is seen that when the conventional two-component type developer is used, a hard tone image is obtained and reproduction of a half tone is difficult, and that the composite developer of the present invention is advantageous in that images of from a soft tone (curve 3) to a hard tone (curve 4) can optionally be obtained by appropriately adjusting the mixing ratio between the magnetic toner particles and the non-magnetic toner particles.

The magnetic toner particles used for the composite developers of this Example were characterized by a volume resistivity of $1.2\times10^{14}$ to $4.6\times10^{14}$ Ω-cm and an electrostatic capacitance of 7.0 to 6.4 pF and a dielectric constant of 3.59 to 3.79 as measured under conditions of an electrode gap of 0.65 mm, an electrode sectional area of 1.43 $cm^2$ and an inter-electrode load of 105 $g/cm^2$. Incidentally, the electrostatic capacitance and dielectric constant of the non-magnetic toner particles were changed according to the amount of carbon black incorporated. If the amount of carbon black was smaller than 3% based on the used resin, the electrostatic capacitance was 6.0 pF and the dielectric constant was 3.08. If the amount of carbon black was larger than 15% based on the resin, the electrostatic capacitance was 8.0 pF and the dielectric constant was 4.10. Accordingly, when the non-magnetic toner particles are used for the developer of the present invention, if the amount of carbon black is below a certain range, the saturation image density is reduced, and if the amount of carbon black exceeds this range, fogging becomes conspicuous. The above-mentioned electric characteristics (electrostatic capacitance and dielectric constant) also have influences on the friction chargeability characteristic. It was confirmed by other experiments that if these electric characteristics are within certain specific ranges, so far as a negative charge controlling agent is contained in the non-magnetic toner particles, the non-magnetic toner particles show a negative friction charge (−0.3 to −2 μC/g) to the magnetic toner particles to be mixed. Even if a positive charge controlling agent is incorporated in the non-magnetic toner particles and a composite developer is prepared by using such non-magnetic toner particles and is used for development, the image density of the obtained copy is reduced and no effect can be obtained.

EXAMPLE 2

In the same manner as described in Example 1, a magnetic toner (particle size distribution of from 6 to 20 μm) was prepared by using agglomerate magnetite of the present invention (apparent density=0.785 g/ml, number average particle size=2.8 μm, coercive force=58 Oe, saturation magnetization=87.2 emu/g, residual magnetization=5.1 emu/g), a thermoplatic resin (styrene/butyl methacrylate copolymer, weight average molecular weight=27000) and high density polyethylene (average molecular weight=4000) at a weight ratio shown in Table 3.

TABLE 3

| Magnetic Toner Particles | Composition (parts) | | |
|---|---|---|---|
| | Magnetite | thermoplastic Resin | High Density Polyethylene |
| e | 75 | 20 | 5 |
| f | 65 | 28 | 7 |
| g | 55 | 36 | 9 |
| h | 45 | 44 | 11 |
| i | 35 | 52 | 13 |

Electric properties of the so-prepared magnetic toner particle are shown in Table 4.

TABLE 4

| Magnetic Toner Particles | Volume Resistivity (Ω-cm) | Electrostatic Capacitance (pF) | Dielectric Constant |
|---|---|---|---|
| e | $9.5\times10^{13}$ | 9.0 | 4.62 |
| f | $2.2\times10^{14}$ | 8.0 | 4.10 |
| g | $8.2\times10^{14}$ | 7.4 | 3.79 |
| h | $8.6\times10^{14}$ | 7.2 | 3.69 |
| i | $2.1\times10^{15}$ | 7.0 | 3.59 |

Non-magnetic toner particles (electrostatic capacitance = 6.9 pF, dielectric constant = 3.54) were prepared in the same manner as described in Example 1 except that the amount of carbon black was changed to 8 parts, and the so-prepared non-magnetic toner particles were mixed in an amount of 5% with the magnetic toner particles shown above. The copying test was carried out by using the so-prepared composite developers in the following manner.

Figure 3:
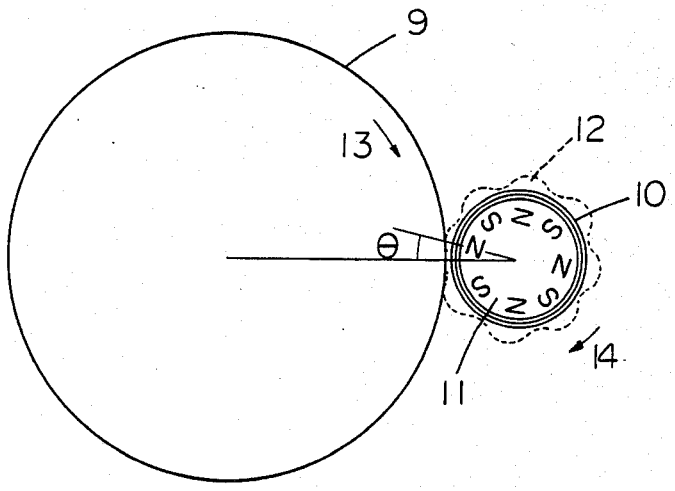
FIG. 3 is a diagram illustrating the position of the magnetic pole in a developing roll.

In a copying machine comprising a selenium drum as a photosensitive material, the composite developer was applied to a developing roller comprising a stationary magnet installed therein through a non-magnetic member while the distance between a spike-cutting plate and the developing roller was adjusted to 0.3 mm, and the distance between the surface of the photosensitive material and the developing roller was adjusted to 0.5 mm and in the contact zone of a brush layer, the photosensitive material is brought in contact with the developing roller (the brush layer) while rotating the developing roller in the same direction as the rotation direction of the photosensitive material at a speed two times the speed of the photosensitive material. Under the foregoing conditions, charging, light exposure, development, transfer and heat fixation were carried out. A Copia test pattern was used as an original and slick paper was used as a transfer sheet. The results of the copying test are shown in Table 5. The image density was a value as obtained by measuring the density of a solid black portion.

ler (brush layer) was rotated in a direction opposite to the rotation direction of the selenium drum in the contact zone and the position of the magnetic pole of an excited stationary magnet was changed, as shown in FIG. 3.

Referring to FIG. 3, a selenium drum 9 is rotated in a direction indicated by arrow 13 by a driving mechanism not shown, and a developing roller 10 is rotated in a direction indicated by arrow 14. The angle between the poleposition of the excited magnet and the line connecting the centers of the drum and developing roller is designated as $\theta$. The test of reproducing the grey scale was carried out by adjusting the angle $\theta$ to 4.5° or 14.5°. The obtained results are shown in FIG. 2.

Figure 2:
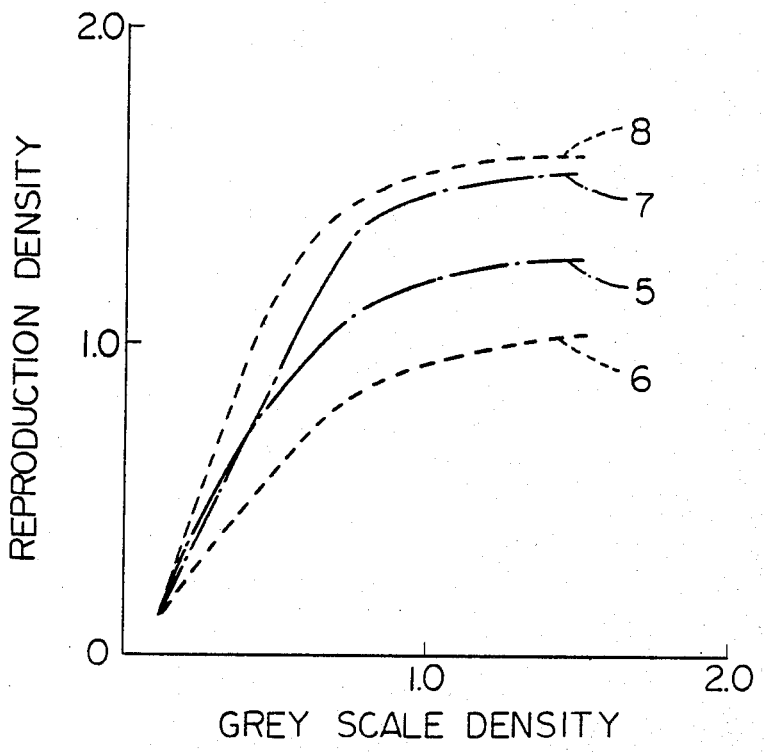
FIG. 2 is a graph illustrating the relation between the grey scale density and the reproduction density in a print obtained by changing the position of the magnetic pole of a developing roll from the magnetic pole position adopted for obtaining the print of FIG. 1.

In FIG. 2, curves 7 and 8 show the results obtained when the angle $\theta$ was 4.5° and curves 5 and 6 show the results obtained when the angle $\theta$ was 14.5°. Solid lines indicate the results obtained when the magnetic toner particles g of Example 2 were used and dot lines indicate the results obtained when the composite developer g' of the present invention was used. As is apparent from the results shown in FIG. 2, when the composite developer of the present invention is used, copies of from a soft tone to a hard tone could easily be obtained by changing the magnetic pole position. Therefore, desirable development conditions for reproducing a half-tone copy original, an original of lines and other optional originals can be set according to the desirable image quality when the composite developer of the present invention is used.

TABLE 5

| | Developers | | | | | | | | | |
|---|---|---|---|---|---|---|---|---|---|---|
| | Magnetic Toner Particles | | | | | Composite Developers | | | | |
| Evaluation Items | e | f | g | h | i | e' | f' | g' | h' | i' |
| Image Density | 0.50 | 1.27 | 1.43 | 1.47 | 1.43 | 1.05 | 1.48 | 1.58 | 1.58 | 1.57 |
| Background Density | 0.09 | 0.09 | 0.10 | 0.11 | 0.20 | 0.09 | 0.09 | 0.10 | 0.11 | 0.20 |
| Sharpness | fair | good | excellent | good | fair to good | good | excellent | excellent | excellent | fair to good |

From the results shown in Table 5, it will readily be understood that by incorporating the non-magnetic toner particles into the magnetic toner particles, the density of the obtained copy is increased, and the contrast is accordingly improved and a clear image can be obtained.

When the amount of the non-magnetic toner particles to be added to the composite developer was examined, it was found that the mixing weight ratio of the magnetic toner particles to the non-magnetic toner particles should be in the range of from 100:1 to 100:30, and that if the amount of the non-magnetic toner particles is smaller than in the above range, the intended effects cannot be attained and if the amount of the non-magnetic toner particles is larger than in the above range, fogging is caused and advantages to be attained by mixing of two kinds of the toner particles are lost.

From the results shown in Tables 4 and 5, it was confirmed that it is preferred that the magnetic toner particles should have an electrostatic capacitance of 7 to 8.5 pF and a dielectric constant of 3.59 to 4.36.

EXAMPLE 3

In the composite developer g' prepared in Example 2, the amount of the non-magnetic toner particles to be added was adjusted to 10%. By using this developer, the copying test was carried out in the same manner as described in Example 2 except that the developing rol- Moreover, when the above composite developer was used for continuous reproduction, the composition of the developer was not changed and the developer components were not degraded.

What we claim is:

1. In a two-component simultaneously consumable, dry-type composite developer which comprises a mixture of magnetic toner particles composed of a dispersion of a powdery magnetic material in an electrically insulating binder resin medium and non-magnetic toner particles composed of a dispersion of a coloring agent in an electrically insulating binder resin medium, the improvement wherein the magnetic toner particles comprise (a) a resin binder medium and (b) 40 to 70% by weight, based on the sum of the binder and powdery magnetic material, of magnetite having a bulk density of at least 0.45 g/ml, a number average maximum size as measured by an electron microscope of at least 0.5 μm and a maximum size/minimum size ratio of from 1.0 to 5.5, the magnetic toner particles have an electrostatic capacitance of 7 to 8.5 pF (picofarad), a dielectric constant of 3.59 to 4.36, and a volume resistivity of $1.2\times10^{-}$to about $8.6\times10^{14}$ Ω-cm, as determined under conditions of an electrode gap of 0.65 mm, an electrode sectional area of 1.43 $cm^2$ and an inter-electrode load of 105 $g/cm^2$, the non-magnetic toner particles comprise (i) a resin binder medium, (ii) 2 to 10% by weight, based on the resin binder medium, of a pigment, and (iii) a negative charge controlling agent composed of a chromium-, iron- or cobalt-containing complex salt dye, and have an electrostatic capacitance of 6.0 to 8.0 pF and a dielectric constant of 3.08 to 4.10, as determined under said conditions, the magnetic toner particles and the non-magnetic toner particles have a friction chargeability characteristic of the same polarity, and the magnetic toner particles and the non-magnetic toner particles are present in the developer at a weight ratio of from 100:1 to 100:30.

2. A developer as set forth in claim 1, wherein the magnetite consists of a non-pulverizable agglomerate of cubic particles and the number average particle size of the agglomerate is in the range of from 1 to 10 μm as measured by an electron microscope.

3. A developer as set forth in claim 2, wherein the agglomerate has an apparent density of 0.5 to 1.5 as measured according to the method of JIS K-5101.

4. A developer as set forth in claim 2, wherein the agglomerate has a saturation magnetization of 75 to 88 emu/g, a residual magnetization of 3 to 12 emu/g and a coercive force of 40 to 150 Oe.

5. A developer as set forth in claim 1 or 2, wherein the magnetic toner particles have a number average particle size of 5 to 35 μm, which is at least 2 times the number average particle size of the magnetite.

6. A developer as set forth in claim 1, 2, 3 or 4 wherein the magnetic toner particles have an electrostatic capacitance of 7.2 to 8.2 pF, and a dielectric constant of 3.69 to 4.21, and the non-magnetic toner particles have an electrostatic capacitance of 6.2 to 7.7 pF and a dielectric constant of 3.18 to 3.95.

7. A developer as set forth in claim 6 wherein the magnetic toner particles comprise (a) said resin binder medium and (b) 45 to 65% by weight, based on the sum of the binder medium and powdery magnetic material, of said magnetite.

8. A developer as set forth in claim 6 wherein the magnetic toner particles and the non-magnetic toner particles are present in the developer at a weight ratio of from 100:2 to 100:20.

* * * * *

UNITED STATES PATENT AND TRADEMARK OFFICE

CERTIFICATE OF CORRECTION

PATENT NO. : 4,404,269

DATED : September 13, 1983

INVENTOR(S) : Nobuhiro Miyakawa, Kouzi Maekawa, Masanori Fujii

It is certified that error appears in the above—identified patent and that said Letters Patent is hereby corrected as shown below:

Claim 1, line 18 change "$1.2 \times 10^{-}$" to ---$1.2 \times 10^{14}$---

Signed and Sealed this

*Fifteenth* Day of *November 1983*

[SEAL]

*Attest:*

GERALD J. MOSSINGHOFF

*Attesting Officer*

*Commissioner of Patents and Trademarks*